US006821211B2

(12) United States Patent
Otten et al.

(10) Patent No.: US 6,821,211 B2
(45) Date of Patent: Nov. 23, 2004

(54) SPORT SWING ANALYSIS SYSTEM

(75) Inventors: Leslie B. Otten, Greenwood, ME (US); Gregory Scott Mills, Albany, ME (US); Thomas E. Lawson, Malvern, PA (US); Bruce E. Perry, Newry, ME (US)

(73) Assignee: GolfTech

( * ) Notice: Subject to any disclaimer, the term of this patent is extended or adjusted under 35 U.S.C. 154(b) by 0 days.

(21) Appl. No.: 09/952,714

(22) Filed: Sep. 14, 2001

(65) Prior Publication Data

US 2003/0054898 A1 Mar. 20, 2003

(51) Int. Cl.[7] ..... A63B 57/00
(52) U.S. Cl. ..... 473/219
(58) Field of Search ..... 463/36–38; 473/219–222, 473/198–200, 140, 141, 151, 407

(56) References Cited

U.S. PATENT DOCUMENTS

| | | | | |
|---|---|---|---|---|
| 4,106,772 A | * | 8/1978 | Krawagna | 473/278 |
| 4,146,230 A | | 3/1979 | Foster | |
| 4,254,956 A | * | 3/1981 | Rusnak | 473/225 |
| 4,342,455 A | * | 8/1982 | Miyamae | 473/222 |
| 4,971,325 A | | 11/1990 | Lipps | |
| 4,991,850 A | | 2/1991 | Wilhlem | |
| 5,067,717 A | | 11/1991 | Harlan et al. | |
| 5,114,150 A | | 5/1992 | Matsumura | |
| 5,209,483 A | | 5/1993 | Gedney et al. | |
| 5,368,042 A | | 11/1994 | O'Neal et al. | |
| 5,472,205 A | * | 12/1995 | Bouton | 473/222 |
| 5,474,298 A | | 12/1995 | Lindsay | |
| 5,685,782 A | * | 11/1997 | Lipps et al. | 473/209 |
| 5,697,791 A | | 12/1997 | Nashner et al. | |
| 5,718,639 A | | 2/1998 | Bouton | |
| 5,826,874 A | | 10/1998 | Teitell et al. | |
| 5,836,829 A | | 11/1998 | Van Cott et al. | |
| 5,882,269 A | | 3/1999 | Lewis et al. | |
| 5,907,819 A | | 5/1999 | Johnson | |
| 5,935,014 A | | 8/1999 | Lindsay | |
| 5,976,022 A | * | 11/1999 | Williams | 473/151 |
| 6,227,984 B1 | * | 5/2001 | Blankenship | 473/221 |
| 6,302,802 B1 | * | 10/2001 | Pao | 473/156 |

FOREIGN PATENT DOCUMENTS

JP 11290496 A 10/1999

* cited by examiner

*Primary Examiner*—John M. Hotaling, II
(74) *Attorney, Agent, or Firm*—James W Wiegand

(57) ABSTRACT

A swing analysis system includes a housing having an upper surface and a ball support mounted to the upper surface. A first array of optical sensors is mounted in the upper surface on a first side of the ball support, and a second array of optical sensors is mounted in the upper surface on a second side of the ball support, opposite the first array of sensors. A third array of optical sensors in mounted in the upper surface, with the sensors positioned around the ball support. A controller is coupled to each sensor of the three arrays of sensors for receiving output signals therefrom. The controller monitors the output signals for change in state events and creates data files containing a sequence of events with associated timestamps. The computer is programmed to use the data files to calculate swing path angle, club head speed, club head angle, club head lateral alignment with respect to the ball support, and club head height of an implement (e.g., a golf club) swung over the housing. The system can also be provided with at least one tower attached to a side of the housing and extending above the upper surface. The tower includes additional sensors that are used by the computer to calculate club head loft angle. The computer can also calculate an effective club head speed from the measured values of club head speed, swing path angle, club head lateral alignment and club head angle.

55 Claims, 3 Drawing Sheets

SPORT SWING ANALYSIS SYSTEM

BACKGROUND OF THE INVENTION

1. Field of the Invention

The present invention relates to devices to aid in analyzing the swing or stroke associated with certain athletic activities. More particularly, the present invention relates to a sensor-based system to detect the path and orientation of the component swung, and a computer system to analyze the data obtained from the sensing system. Still more particularly, the present invention is well suited to the analysis of the swing of a golf club but is not limited thereto.

2. Description of the Prior Art

There are many ways for participants in athletic activities to improve their skills in order to improve performance. One obvious way is to practice the skills and strategies associated with the particular activity. In addition, there exist devices and systems that a sport participant can use to make critical evaluations of the techniques and mechanics associated with the particular sport. For example, football and baseball players can review videotapes of their efforts during the course of a game or practice. Based on flaws detected during the review, the participant can adjust mechanics and/or strategies. However, in certain athletic activities, particularly those involving the use of an implement moving at a high rate of speed, it can be difficult to assess accurately any flaws in the effort Such activities include, but are not limited to, tennis, baseball (bat swinging), ice hockey, field hockey, lacrosse, and golf.

In the sport of golf in particular, there have been a number of advances in golf club swing analysis. Initially, an individual mentor or coach would observe a player swing a club to hit a ball and then critique the swing. While a skilled observer can detect flaws in a swing, the human eye may not be able to make an assessment that is complete and completely correct. Moreover, the expense associated with a personal coach can be prohibitive for many participants. Given the wide popularity of golf, there are many individuals unable to take advantage of the expertise of a skilled swing observer. Therefore, when the portable video camera became commonly available, it provided a convenient method for local golf course professionals and other golf teachers to observe more players' swings more critically. Further, it enabled individual players to record and assess their own swing. However, as with observation by a skilled teacher, it is difficult for an individual to analyze completely and completely accurately the flaws in his or her own swing. Additionally, even skilled observers cannot assess a swing completely based on videotape.

More recently, systems have been described to aid in the analysis of a golf swing. For example, U.S. Pat. No. 5,718,639 issued to Bouton describes a golf club swing sensing system and a method of playing a simulated golf game. In particular, Bouton provides a mat with a plurality of photodetectors used to record the passage of a reflector applied to the golf club head. The output of the detectors is transmitted to a computer system that produces a video representation of the swing. Alternatively, U.S. Pat. No. 5,474,298 issued to Lindsay describes a swing analyzer that includes a magnet set applied to a club head and an inductive array positioned in the vicinity of the club head path. As the magnets pass over (or do not pass over) the inductive array, electrical signals are or are not transmitted to an analyzer. The signal set is then converted into an indication of swing path and that detected path is compared to an idealized path.

The user is then informed about swing deviation and can work to adjust the swing.

While the prior systems appear to improve upon the relatively inaccurate method of swing analysis by videotape, they provide information on a limited number of swing parameters. As a result, these devices fail to provide a complete assessment of the golf swing. In particular, the prior systems do not completely assess the orientation of the club head at the point of impact.

Therefore, it would be desirable to have a swing analysis system that was able to assess a large number of swing or club head parameters.

SUMMARY OF THE INVENTION

The above-mentioned need is met by the present invention, which provides a swing analysis system comprising a housing having an upper surface and a ball support mounted to the upper surface. A first array of optical sensors is mounted in the upper surface on a first side of the ball support, and a second array of optical sensors is mounted in the upper surface on a second side of the ball support, opposite the first array of sensors. A third array of optical sensors in mounted in the upper surface, with the sensors positioned around the ball support. A controller is coupled to each sensor of the three arrays of sensors for receiving output signals therefrom. The controller monitors the output signals for change in state events and creates data files containing a sequence of events with associated timestamps. A computer is connected to the controller for receiving the data files. The computer is programmed to use the data files to calculate swing path angle, club head speed, club head angle, club head lateral alignment with respect to the ball support, and club head height of an implement swung over the housing. The system can also be provided with at least one tower attached to a side of the housing and extending above the upper surface. The tower includes additional sensors that are used by the computer to calculate club head loft angle. The computer can also calculate an effective club head speed from the measured values of club head speed, swing path angle, club head lateral alignment and club head angle.

The present invention and its advantages over the prior art will become apparent upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
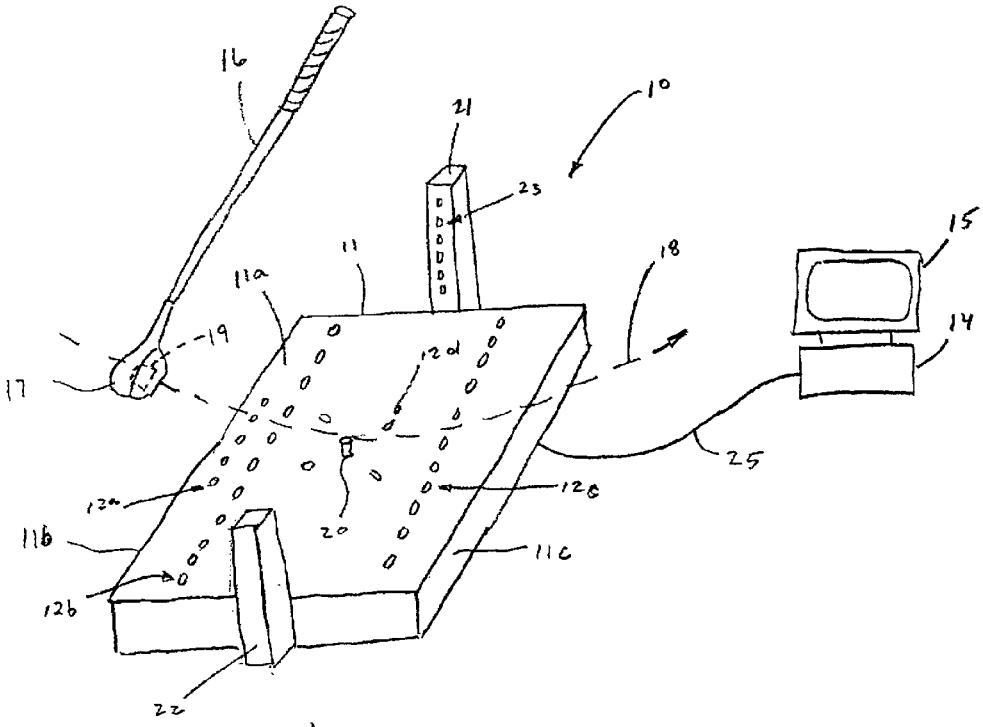
FIG. 1 is a perspective view of a swing analysis system of the present invention.
Figure 2:
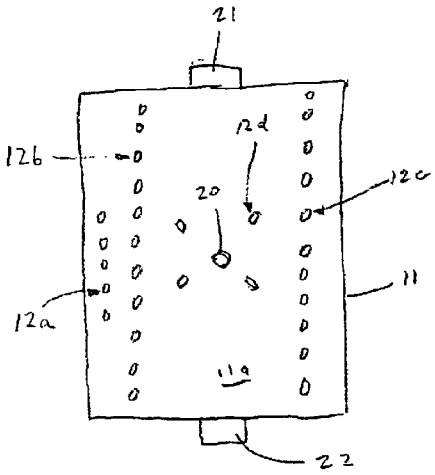
FIG. 2 is a top view of the swing analysis system of FIG. 1.
Figure 3:
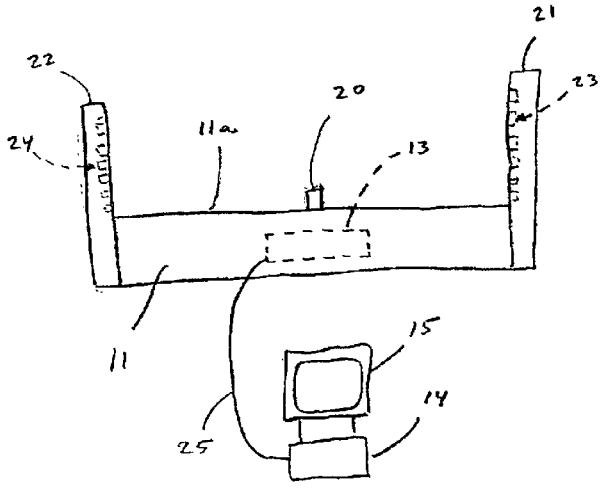
FIG. 3 is a side view of the swing analysis system of FIG. 1.

A swing analysis system 10 in accordance with one embodiment of the present invention is shown in FIGS. 1–3. The system 10 includes a sensor housing 11 or equivalent structure for containing therein a plurality of sensors that are preferably photodetectors. As will be described in more detail below, the sensors contained in the housing 11 are arranged into four groups or arrays, identified in FIGS. 1–3 by reference numerals 12*a*, 12*b*, 12*c* and 12*d*, respectively. The system 10 further includes a controller 13 coupled to the sensors 12*a–d* and to a computer device 14, such as a personal computer or minicomputer having a display 15. The controller 13 is also preferably retained in the housing 11 but is not limited thereto. Instead, it may be located remotely from the housing 11.

The sensor housing 11 is fabricated of a non-metallic material that is resilient and that can be used to retain the sensors 12*a–d* thereto. In one preferred embodiment, the sensors are optical sensors of the reflective type. Reflective-type sensors include an emitter (typically an infrared emitter) and a photodetector that is capable of detecting reflected light that has been emitted by the emitter. The sensor produces a signal whenever the photodetector senses light. One preferred reflective-type sensor that can be used for the sensors 12*a–d* comprises a QED123 emitter and a QSD123 detector, both commercially available from QT Optoelectronics. The housing 11 is primarily made of opaque material except that transparent ports are provided in an upper surface 11*a* thereof at the locations where the sensors 12*a–d* are placed. The ports can be open or may optionally be covered by glass, Plexiglas, or other suitable material that does not block the light but that seals the sensors from the environment. In use, the housing 11 is positioned such that when a sporting implement, such as golf club 16, is swung, the club head 17 travels along a swing path 18 that passes over the housing upper surface 11*a*. Specifically, the swing path 18 passes over the housing back edge 11*b*, certain ones of the sensors 12*a–d*, and then the housing front edge 11*c*.

The sensors 12*a–d* are designed to emit a narrow beam of infrared light. By applying a reflective material, such as a piece of reflective tape 19, to the underside of the club head 17, light emitted from the sensors 12*a–d* is reflected back thereto when the club 16 is swung through the swing path 18. Detector elements associated with the sensors 12*a–d* detect the reflected light and generate an electrical signal that passes via conventional cabling means to the controller 13. Typically, the sensor output signals are analog signals that are conditioned as analog signals and are then converted to digital signals, using high-speed comparators, before being fed tot he controller 13. The sensors 12*a–d* are tuned to detect reflected light with maximum sensitivity at the frequency of the emitted light. The light striking the detectors is modulated by the passage of the reflective tape 19 as the club 16 travels along a swing path 18.

As mentioned above, the sensors 12*a–d* mounted in the upper surface 11*a* of the housing 11 are configured in a first array (sensors 12*a*), a second array (sensors 12*b*), a third array (sensors 12*c*), and a fourth array (sensors 12*d*). Those arrays are arranged and configured to ensure that complete information regarding the swing is provided. The sensors 12*a* of the first array are arranged near the back edge 11*b* of the housing 11. The sensors 12*a* are thus the first sensors that the club head 17 passes over when the club 16 is swung through the swing path 18. Accordingly, the first sensors 12*a* function as a trigger to the system 10 such that the controller 13 is prepared to begin taking data upon passage of the club head 17 over the other sensors 12*b–c*. When the first sensors 12*a* are triggered by the passage of the club head 17, the other sensors 12*b–d* are activated. This allows the emitter portions of the sensors 12*b–d* to be run briefly at high power to increase sensitivity and save power.

The sensors 12*b* of the second array are arranged near to, and slightly inward from, the array of first sensors 12*a*. The sensors 12*c* of the third array are arranged near the front edge 11*c* of the housing 11. As shown in the Figures, the first, second and third sensors 12*a–c* are arranged in three substantially parallel rows that are generally perpendicular to the intended swing path 18. However, it should be noted that the system 10 is not limited to this particular sensor configuration. The sensors arrays can be arranged in any of a number of configurations that intersect the swing path 18.

As seen in FIGS. 1 and 2, each of the second and third rows of sensors 12*b* and 12*c*, has a relatively large number of sensors (generally more than the first row) that are distributed substantially across the entire width of the housing upper surface 11*a*. In one possible embodiment, the second row includes 11 sensors 12*b*, each spaced apart from one another about ½-inch, and the third row includes the same number of sensors 12*c* spaced apart from one another in the same manner. The second and third sensors 12*b*, 12*c* are preferably positioned perpendicular to the housing upper surface 11*a* so that maximum detection occurs when an object passes directly overhead.

A tee or ball support 20 is mounted to the housing upper surface 11*a* (i.e., mounted on top of the upper surface 11*a* or arranged to extend therethrough), roughly in the center thereof so as to be located between the second and third rows of sensors 12*b*, 12*c*. Typically, the tee 20 protrudes through an appropriately positioned hole in the upper surface 11*a*. The tee 20 supports a ball that can be struck with the club 16. The output of the second and third sensors 12*b*, 12*c* is used to determine the angle of the club's swing path angle and the club head's lateral alignment with the tee 20 (and thus a ball on the tee 20) upon ball impact, thereby indicating if the ball is struck on the center of the club head face (i.e., the "sweet spot") or if the ball is struck on the heel or toe of the club head 17. These determinations are based on the precise timing of the passage of the reflective tape over the sensors. The output of the second and third sensors 12*b*, 12*c* (or other sensors) can also be used to detect the club head speed (based on the travel time between the second and third rows of sensors). Lastly, the output of the second and third sensors 12*b*, 12*c* is used to detect the club head angle, which indicates whether the club face is square to the ball being struck, or is open or closed in relation to the ball. This detection is made based on which ones of the sensors 12*b* and 12*c* are actuated and the relative timing thereof within each row.

The sensors 12*d* of the fourth array include four sensors positioned around the tee 20. The fourth sensors 12*d* are preferably mounted in the housing upper surface 11*a* so as to be angled toward the tee 20. It is to be noted that while four sensors 12*d* are shown in FIG. 1, more or fewer such sensors can be employed. The sensors 12*d* of the fourth array are used to evaluate club head height before and after the point of impact, which provides further information on how the ball is struck relative to the sweet spot of the club head face. Club head height is determined using a technique that is a variation on standard triangulation for distance determination. The time difference between when the club head 17 crosses a vertical beam from the sensors 12*b* and when it crosses an angled beam from the sensor 12*d* is a function of both height and velocity. Because club head speed is known from the transit time between the second and third sensors 12*b* and 12*c*, the distance the club head 17 travels between the vertical beam and the angled beam can be calculated from the transit time between the two beams. Club head height can be determined from this distance and the angle of the beam emitted from the fourth sensor 12*d* using simple geometry.

In addition to the sensors 12*a–d* mounted in the housing 11, the system 10 includes an optional sensing means located above the upper surface 11*a*. Specifically, first and second towers 21, 22 are removably attached to respective sides of the housing 11 so as to extend upwardly from the upper surface 11*a*. The towers 21, 22 are aligned with one another and the tee 20. A row of photoemitters 23 extend up the first tower 21 and a row of photodetectors 24 extend up the second tower 22. Each photodetector 24 is aligned with a corresponding one of the photoemitters 23 so that the photodetectors 24 detect blockage of the light emitted by photoemitters 23 when the club head 17 passes. Based upon which ones of the photodetectors 24 transmits a signal indicating blockage and the timing of such signals, the club head loft angle (i.e., the angle of the club face with respect to vertical) at ball impact can be detected. Thus, the output of the photodetectors 24 is used to determine whether the club face is positioned level, at a downward angle, or at an upward angle.

As an alternative to using photoemitters and photodetectors on opposite sides of the housing 11, it is possible to use a single tower extending upwardly from the upper surface 11*a* on one side of the housing 11 and aligned with one another and the tee 20. A linear array of reflective-type sensors like the sensors 12*a–d* extending up this single tower would function to detect the loft angle of the club head 17 based on which ones of the sensors were actuated and the timing of such actuations.

While the Figures show the towers 21, 22 to extend perpendicularly to the housing upper surface 11*a*, it is also possible that both towers 21, 22 form a non-right angle, such as 45 degrees, with the upper surface 11*a*. In this way, the vertical spacing between adjacent photoemitters and photodetectors can be reduced (so as to increase detection sensitivity) without reducing the actual distance between adjacent photoemitters and photodetectors.

With continuing reference to FIGS. 1–3, each of the sensors 12*a–d* and the photodetectors 24 is able to deliver its output signal to the controller 13. In one embodiment, this is accomplished with a printed circuit board (PCB), wherein each sensor and photodetector is connected to a corresponding one of the PCB's conductors. The controller 13 preferably includes a signal analyzer to tag the particular sensor/photodetector associated with each of the wires. The controller 13 is also configured to control the operation of the sensors 12*a–d* and photodetectors 24 and to provide clocking information associated with received signals. The controller 13 is preferably configured to tag which sensors and photodetectors have transmitted signals indicating their actuation and the time of actuation at a frequency of about 100 kHz, for a corresponding timing rate of about 0.00001 second intervals. The controller 13 is preferably, but not necessarily a PIC RISC microcontroller from Microchip, Inc.

Figure 4:
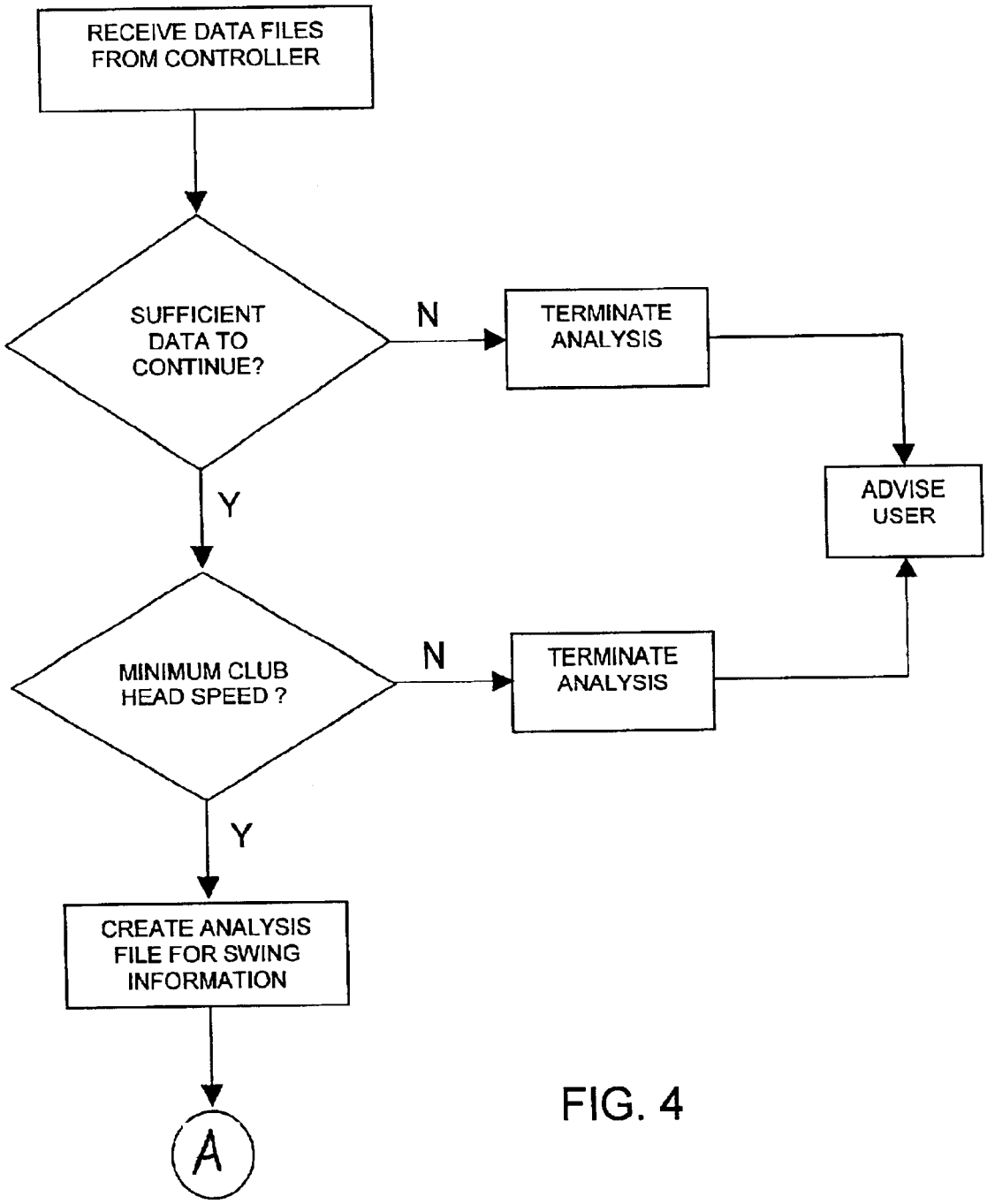
FIG. 4 is a simplified flow diagram of the steps associated with the capture of detector signals, transmission of those signals, digitized, to the computer device, and preparation of a temporary file of the digitized data provided by the system of the present invention.

As illustrated in FIG. 4, the computer device 14 is programmed to derive information of value from digitized signals fed from the controller 13. Those skilled in computer programming will be able to create a program in a suitable language to enable the data manipulation represented in the accompanying figures. For the following discussion, the term "sensor device" is intended to encompass the sensors 12*a–d* and the photodetectors 24. First, data files are fed from the controller 13 to the computer 14 via a signal connector cable 25 that may be a parallel connector or preferably a serial connector of conventional design, such as a universal serial bus line, other serial interfaces, or wireless connector. The controller 13 monitors the sensor devices for change in state events and creates data files containing a sequence of events with their associated timestamps. As used herein, a "change in state event" occurs whenever the leading or trailing edge of the reflective tape 19 passes over a sensor device. Each file includes at least a particular sensor device identifier, a status field, and a time-of-actuation field. The sensor device identifier may be any sort of identifier recognizable by the program. The status field may be an ON/OFF indication, e.g., simply a "1" or a "0" representing whether the particular sensor device was actuated during a swing event. The time field is filled with the particular time of actuation as compared to actuation of the other sensor devices.

The computer 14 is programmed to assess whether a sufficient number of the individual sensor devices were actuated for the purpose of making a swing assessment. The required minimum number of filled temporary folders is selectable by the program creator. If an insufficient number had been filled, such as if the swing path 18 was wild or incomplete, the analysis process is terminated and the user is advised accordingly. If a sufficient number of fields have been filled, the analysis process continues by determining whether data from the sensors 12*b* and 12*c* confirm a minimum gross club head speed has been detected. That initial speed evaluation is preliminarily made by calculating the spacing differential between particular actuated ones of the sensors 12*b* and 12*c* of common rows and dividing that number by the time differential or lapse of actuation between such particular sensors. The minimum speed could be any value, such as 20 miles per hour, sufficient for determining if a legitimate swing has occurred. Alternatively, no minimum could be used for analyzing putting strokes. If that minimum calculated speed has not been reached, the analysis process is terminated and the user so advised. If the minimum speed has been reached and a sufficient number of sensors 12*b* and 12*c* are actuated, a file is created from the temporary folders data for detailed analysis related to swing characteristics.

Figure 5:
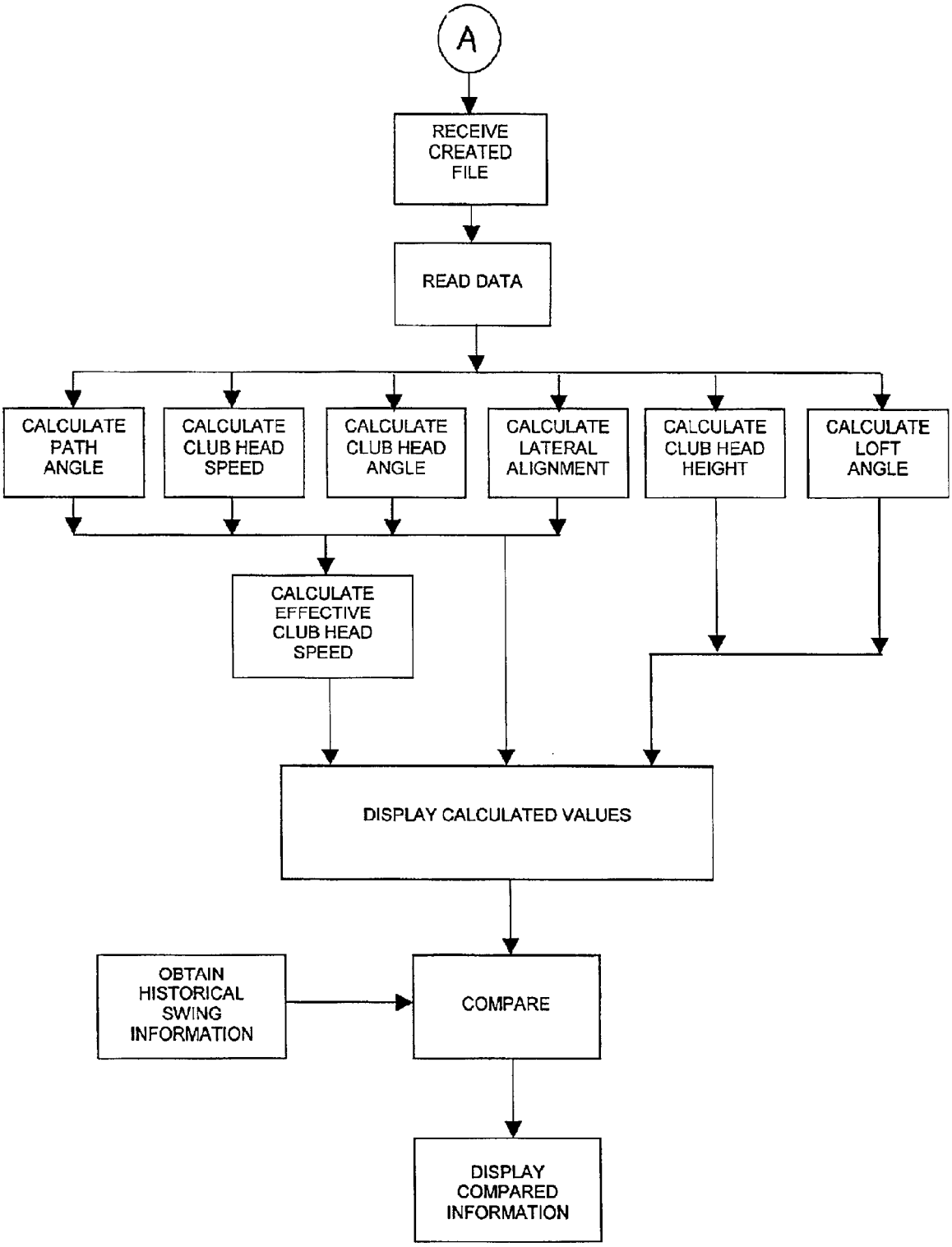
FIG. 5 is a simplified flow diagram of the steps associated with the manipulation of the digitized information to produce a swing analysis representation.

As illustrated in FIG. 5, the data from the data files are read and then manipulated to produce specific swing related information. Specifically, the computer 14 is programmed to correlate and use the output of the second and third sensors 12*b* and 12*c* in relatively simple equations to determine the path angle, club head speed, club head angle and club head lateral alignment in the manner described above. The computer 14 also determines club head height before and after impact from the output of the second and fourth sensors 12*b* and 12*d*, and optionally the club head loft angle from the output of the photodetectors 24. In addition, the effective club head speed, rather than the measured club head speed, may be calculated from the other calculations. In particular, this rating is calculated based on the ratio of the club head angle, the relation of the club head to center, and the swing path to those parameters for an idealized swing, and multiplying that fraction by the measured club head speed to obtain an overall or composite swing rating.

By basing the time stamp list on the first derivative of the sensor outputs (which is taken as part of the analog signal conditioning in the sensors), the computer 14 can better distinguish the passage of the reflective tape 19 from artifact. This is because the club head speed is known, and the precise timing relationship between passages of the leading and trailing edges of the tape 19 is known. The system 10 can thus function in the presence of a strong background light source such as bright sunlight. The computer 14 can also use the transit time of the reflective tape 19 over one of the sensors 12*a–d* to distinguish the club head 17 from an artifact or shadow when direct sunlight is present. In direct sunlight, there may be spurious signals from shadows and reflections for each valid event, an "event" being whenever the leading or trailing edge of the tape 19 passes over a sensor. Using a tape of a fixed width (such as ⅜ inch) allows the computer 14 to distinguish between a true signal and an artifact. Specifically, all true signals will show a duration between the leading edge event and the trailing edge event that corresponds to the tape width and measured club head speed. It is possible for artifact to coincidentally produce a pair of events with the same time spacing, but it is unlikely three such event pairs would occur in succession so as to simulate the passage of the reflective tape 19 over the three sets of sensors 12*b–d*. Therefore, event pairs of the expected duration occurring in succession over the three sets of sensors 12*b–d* will be indicative of an actual club head passing. All other signals will be attributed to artifact and disregarded.

The described calculated values may then be displayed as textual information, a simple graphic representation, a multimedia representation, or any combination thereof on the display 15 of the computer device 14. This may be achieved by any graphics program package well known to those skilled in the art. Additionally, the computer 14 may optionally be further programmed to retrieve historical swing information associated with that user, another user, or a popular professional player. The user may than compare his or her effective speed information and swing path to the historical information. The system 10 may be cleared and a following swing analysis performed. Optionally, the swing information may be tied to a computer representation of a game simulation. The accurate swing information generated by the system 10 may be integrated into a course representation and a more accurate indication of the user's score on that course may be established.

While specific embodiments of the present invention have been described, it will be apparent to those skilled in the art that various modifications thereto can be made without departing from the spirit and scope of the invention as defined in the appended claims.

What is claimed is:

1. A golf swing analysis system for analyzing the swing of a club equipped with a reflective material having a non-uniformly-reflective surface characterized leading and trailing edges and positioned on the head of the club, comprising:

a ball support;

a plurality of sensors spatially arranged relative to the ball support, each sensor providing a signal indication in response to sensing each of the leading and trailing edges of the reflective material as the head of the club swings through the ball support; and a computer for analyzing the swing of the club as a function of, at least in part, which sensors sense the leading and trailing edges of the reflective material, and the timing relationship between passage of the leading and trailing edges detected by each such sensor.

2. A golf swing analysis system according to claim 1, wherein the plurality of sensors are arranged and the computer is programmed so as to calculate a swing path angle.

3. A golf swing analysis system according to claim 1, wherein the plurality of sensors are arranged and the computer is programmed so as to calculate club head speed.

4. A golf swing analysis system according to claim 1, wherein the plurality of sensors are arranged and the computer is programmed so as to calculate club head angle.

5. A golf swing analysis system according to claim 1, wherein the plurality of sensors are arranged and the computer is programmed so as to calculate club head lateral alignment with respect to the ball support.

6. A golf swing analysis system according to claim 1, wherein the plurality of sensors are arranged and the computer is programmed so as to calculate club head height of an implement swung over the ball support.

7. A golf swing analysis system according to claim 1, wherein the plurality of sensors are arranged and the computer is programmed so as to calculate club head loft angle.

8. A golf swing analysis system according to claim 1, wherein the sensors are arranged in at least three arrays positioned so that a first array is located on a first side of the ball support, a second array is located on a second side of the ball support, opposite the first array, and the third array is positioned in proximity to the ball support.

9. A golf swing analysis system according to claim 8, wherein as a club swings through the ball support, the leading and trailing edges of the reflective material is sequentially sensed by the sensors of the first, second and third arrays.

10. A golf swing analysis system according to claim 9, wherein the first array triggers the system so that the system is prepared to begin accepting data from other sensors.

11. A golf swing analysis system according to claim 10, wherein the first array triggers the system so that some of the sensors can operate at high power levels at increased sensitivity.

12. A golf swing analysis system according to claim 9, wherein the second and third arrays provide data as a function of the club's swing path angle and the club head's lateral alignment wit the ball support upon ball impact.

13. A golf swing analysis system according to claim 9, wherein the second and third arrays provide data as a function of the club head speed based upon the travel time between sensors of the second and third arrays.

14. A golf swing analysis system according to claim 9, wherein the second and third arrays provide data as a function of the club head angle.

15. A golf swing analysis system according to claim 9, further including a fourth array of sensors, each angled toward the ball support so as to provide data as a function of the club head height before and after the point of impact between a club and a ball on the ball support.

16. A golf swing analysis system according to claim 1, wherein a golf club includes a head face and defines a sweet spot on the club head face, and the plurality of sensors include at least one array for use in calculating club head height before and after the point of impact, and how a ball is struck relative to the sweet spot of the club head face.

17. A golf swing analysis system according to claim 1, further including sensors constructed and arranged so as to sense the club head loft angle and position above and to the side of the ball support.

18. A golf swing analysis system according to claim 17, wherein the sensors constructed and arranged so as to sense the club head loft angle include at least one array arranged in a vertical row.

19. A golf swing analysis system according to claim 1, wherein the sensors constructed and arranged so as to sense the club head loft angle include at least two arrays arranged in a vertical row, and positioned on opposite sides of the ball support.

20. A golf swing analysis system according to claim 1, wherein the sensors include at least one array of at least four sensors positioned around the ball support.

21. A golf swing analysis system according to claim 1, wherein each sensor is constructed to emit a narrow beam of infrared light.

22. A golf swing analysis system according to claim 21, wherein each sensor is tuned to detect infrared light at the frequency emitted by the sensor.

23. A golf swing analysis system according to claim 1, further including a controller constructed and arranged so as to monitor the sensors for change in state events.

24. A golf swing analysis system according to claim 23, wherein a change in state event occurs whenever the leading or trailing edge of the reflective material is sensed by the sensor.

25. A golf swing analysis system according to claim 23, wherein the change in state events is a function of the first derivative of an output of each sensor so as to distinguish the passage of the reflective material from artifact.

26. A golf swing analysis system according to claim 1, wherein the computer is further configured and arranged so as to determine whether a swing path of a club is complete or wild.

27. A golf swing analysis system according to claim 1, wherein the computer is further configured and arranged so as to determine whether a minimum gross club head speed has been detected.

28. A golf swing analysis system according to claim 1, wherein the computer is further configured and arranged so as to provide historical swing information.

29. A method of analyzing a golf swing, comprising:

applying a reflective material to the head of a club to form a non-uniformly-reflective surface characterized by leading and trailing edges; and sensing the leading and trailing edges of the reflective material as it passes over each of a plurality of sensors;

analyzing data generated by each of the multiple sensor over which the reflective material has passed.

30. A method according to claim 29, wherein sensing the leading and trailing edges of the reflective material as it passes over multiple sensors includes generating data as a function of the first derivative of outputs from the multiple sensors.

31. A golf swing analysis method for use with a golf club having a strip of reflective material that forms a non-uniformly-reflective surface characterized by leading and trailing edges, comprising the steps of:

(A) emitting a light toward a location in a path of the swung golf club;

(B) receiving light reflected from the reflective material; and (C) generating at least one signal for each transition in light level reflected from the reflective material corresponding to a leading or trailing edge of the reflective material.

32. The method of claim 31 wherein step (C) further comprises the steps of:

(C1) differentiating a signal generated by light reflected from the reflective material; and (C2) correlating the differential signal to transitions in light levels reflected from the reflective material.

33. The method of claim 32 wherein the width of the reflective material is predetermined and the method further comprises the step of:

(D) dividing the width of the reflective material by the time between two transitions in light reflected from the reflected material to obtain the club head speed.

34. The method of claim 33 further comprising the step of:

(E) comparing the club head speed to a threshold club head speed to determine whether the transitions in light level are associated with club head movement of interest or the transitions are associated with an undesirable artifact.

35. The method of claim 34 further comprising the steps of:

(H) correlating reflected light signals for a plurality of locations to determine whether the light level transitions are associated with club head movement of interest or the transitions are associated with an undesirable artifact.

36. The method of claim 32 further comprising the steps of:

(F) receiving reflected light at a plurality of locations; and (G) dividing the distance between two receiving locations by the time between two light transition events to obtain the club head speed.

37. The method of claim 31 further comprising the step of:

(J) employing a plurality of transmitters and receivers along the expected golf club head flight path; and (K) using one or more of the receivers as a trigger for other transmitters and receivers, whereby the activation of a trigger receiver by reflected light activates non-trigger transmitters and receivers.

38. The method of claim 31 further comprising the step of:

(L) computing a club swing path angle.

39. The method of claim 31 further comprising the step of:

(M) computing a club head angle.

40. The method of claim 31 further comprising the step of:

(N) computing a club head lateral alignment.

41. The method of claim 31 further comprising the step of:

(O) computing an effective club head speed.

42. The method of claim 31 further comprising the step of:

(P) arranging emitters and detectors perpendicular to the direction of club head travel and parallel to the plane of the club head flight and sensing reflected light to determine the loft angle of the club.

43. A golf swing analysis system for use with a golf club to be swung, comprising:

a non-uniformly-reflective surface characterized by leading and trailing edges coupled to the golf club head;

a light source configured to emit light toward a location in a path of the swung golf club;

a light receiver configured to receive light reflected from the non-uniformly-reflective surface; and a processor configured to generate at least one signal for each transition in light level reflected from the reflective material attached to the club.

44. The system of claim 43 wherein the processor is further configured to:

differentiate a signal generated by light reflected from the non-uniformly-reflective surface; and correlate the differentiated signal to transitions in light levels reflected from the non-uniformly-reflective surface.

45. The system of claim 44 wherein the processor is further configured to:

divide the width of the attached reflective material by the time between two transitions in light reflected from the non-uniformly-reflective surface to obtain the club head speed.

46. The system of claim 45 wherein the processor is further configured to:

compare the club head speed to a threshold club head speed to determine whether the transitions in light level are associated with an undesirable artifact.

47. The system of claim 46 wherein the processor is further configured to:

correlate reflected light signals for a plurality of locations to determine whether the light level transitions are associated with an undesirable artifact.

48. The system of claim 44 wherein the processor is further configured to:

receive reflected light at a plurality of locations; and divide the distance between two receiving locations by the time between two light transition events to obtain the club head speed.

49. The system of claim 43 wherein the processor is further configured to:

employ a plurality of transmitters and receivers along the expected golf club head flight path; and use one or more of the receivers as a trigger for other transmitters and receivers, whereby the activation of a trigger receiver by reflected light activates non-trigger transmitters and receivers.

50. The system of claim 49 wherein the processor is further configured to activate non-trigger transmitters and receivers at a high power level in response to the activation of a trigger receiver.

51. The system of claim 43 wherein the processor is further configured to:

compute a club swing path angle.

52. The system of claim 43 wherein the processor is further configured to:

compute a club head angle.

53. The system of claim 43 wherein the processor is further configured to:

compute a club head lateral alignment.

54. The system of claim 43 wherein the processor is further configured to:

compute an effective club head speed.

55. The system of claim 43 further comprising:

emitters and detectors arranged perpendicular to the direction of club head travel and parallel to the plane of club head flight, the processor configured to determine the loft angle of a passing club from reflected light sensed by the detectors arranged perpendicular to the direction of club head travel.

* * * * *